US005338359A

United States Patent [19]

Conroy et al.

[11] Patent Number: 5,338,359

[45] Date of Patent: Aug. 16, 1994

[54] HOPPER PREPARATION PAN WITH EDGE WALLS

[75] Inventors: James E. Conroy; William D. Devine; Kenneth J. Ruschak, all of Rochester, N.Y.

[73] Assignee: Eastman Kodak Company, Rochester, N.Y.

[21] Appl. No.: 147,352

[22] Filed: Nov. 3, 1993

[51] Int. Cl.[5] ..... B05C 11/00

[52] U.S. Cl. ..... 118/412; 118/DIG. 4; 118/429

[58] Field of Search ..... 118/429, DIG. 4, 412, 118/410, 411, 419; 427/420

[56] References Cited

U.S. PATENT DOCUMENTS

| | | | |
|---|---|---|---|
| 3,508,947 | 4/1970 | Hughes | 117/34 |
| 4,019,906 | 4/1977 | Ridley | 96/68 |
| 4,060,649 | 11/1977 | Coleman | 427/79 |
| 4,479,987 | 10/1984 | Koepke et al. | 427/402 |
| 4,559,896 | 12/1985 | Bossard et al. | 118/300 |
| 4,830,887 | 5/1989 | Reiter | 427/420 |
| 4,851,268 | 7/1989 | Kozak | 427/420 |
| 4,933,215 | 6/1990 | Naruse et al. | 427/420 |
| 4,974,533 | 12/1990 | Ishizuka et al. | 118/411 |
| 5,044,305 | 9/1991 | Shibata et al. | 118/73 |
| 5,105,758 | 4/1992 | Kozak | 118/300 |

*Primary Examiner*—W. Gary Jones
*Assistant Examiner*—Brenda Adele Lamb
*Attorney, Agent, or Firm*—Carl F. Ruoff

[57] ABSTRACT

The present invention is an apparatus for preparation of a coating hopper. A preparation pan is positioned beneath the hopper lip during hopper preparation wherein flow within the hopper is chaotic and the curtain is not stable. The preparation pan includes edge walls spaced apart from the edge guides to stabilize the unsteady curtain within the preparation pan. The invention minimizes splashing and splattering of the coating liquids thereby minimizing contamination of the coating equipment.

11 Claims, 5 Drawing Sheets

HOPPER PREPARATION PAN WITH EDGE WALLS

FIELD OF THE INVENTION

The present invention relates to preparation pans for use in preparing coating hoppers. More particularly, the present invention relates to an improved curtain coating preparation pan for use in the manufacture of photographic materials such as photographic film and paper.

BACKGROUND OF THE INVENTION

In curtain coating, a traveling web or object is coated by a free-falling curtain of coating liquid that is caused to impinge onto the traveling web or object to form a layer thereon. The width of the free-falling curtain is maintained by edge guides that are in wetting contact with the lateral boundaries or edges of the curtain. For example, in aqueous solution systems for photographic products it is known to use a curtain coating method which comprises the simultaneous application of silver halide emulsions containing gelatin as a binder, by using a slide hopper coating apparatus to form a multilayer photographic film or paper. A moving web is coated by a free-falling curtain of coating composition wherein the multilayer composition is formed on the slide hopper and caused to fall as a curtain and impinge the moving web to form the coated layer thereon. The formation of a composite of a plurality of distinct layers on a moving web is described in U.S. Pat. No. 3,508,947, which relates particularly to the manufacture of multilayer photographic materials such as photographic film and paper.

In the process of curtain coating, the coating hopper is usually filled and flushed with water or cleaning solution for some time prior to being filled with coating solutions. This procedure will henceforth be referred to as hopper preparation. As the hopper is flushed with water and the water is purged from the hopper by the coating solutions, the flow through the hopper may not be steady. In other words, during hopper preparation it is con, non to-encounter flow rate pulsations on the hopper slide and in the curtain. During this time it is difficult to maintain a full width curtain without breaking due to the unsteady flow and fluid inhomogenities. This generally causes the curtain to degenerate and break into an unsteady, uncontrolled flow. As these solutions leave the hopper lip they have a long distance to fall before they contact a solid surface. The solutions accelerate as they fall. The result of the impingement of the high velocity unsteady fluids on a solid surface is splashing in the coating area. This splashing or splattering can contaminate equipment with water and/or coating solutions.

Contamination of equipment such as the boundary air vacuum baffle, edge guides or high speed start/finish pan can result in unacceptable coating quality causing waste in manufacturing. During hopper preparation, the hopper is not directly over the coating roller or the coating impingement point. The hopper is translated to a position in front of the coating roller in an effort to keep the coating point free of contamination. However, even though some distance separates the curtain from the coating point, splashing may still contaminate the surfaces unless the fluids are well controlled in the hopper preparation position.

It is not practical given the economics, design optimization and space constraints to locate the hopper preparation position far enough from the coating position to prevent contamination at the coating point. For this reason, a device known as a preparation pan is inserted directly below the hopper lip during hopper preparation. The preparation pan intercepts most, but not all, of the fluids flowing off the hopper lip during hopper preparation. Since the preparation pan cannot physically interfere with the edge guide, its width is less than the curtain width and it cannot intercept the fluids that flow off the hopper lip and fall in the vicinity of the edge guides. As a result, while the preparation pan is fairly successful in preventing contamination of the equipment located near the coating point, it does not prevent contamination of the edge guides. Even if equipment in the area of the coating point is kept free from contamination, contamination of the edge guides is a significant problem. The splashing in the hopper preparation position frequently contaminates the edge guides. Any disturbance to the natural path desired by the curtain will result in a wave in the curtain. A stationary disturbance, such as contamination on the edge guides, will result in a standing wave in the curtain. A standing wave will result in a longitudinal streak being seen at the position on the support that the wave strikes which can be several centimeters in from the edge guide. In addition to causing a streak at the point at which they strike the support, waves can also redistribute fluid in the entire area underneath them, therefore compromising the uniformity of the coating from the edge to the wave.

The present invention is an apparatus which improves the preparation of a coating hopper by reducing the amount of splashed material which can cause contamination of the surrounding coating equipment.

SUMMARY OF THE INVENTION

The present invention is an apparatus for preparing a coating hopper having one or more parallel metering slots between one or more hopper elements. The hopper elements form a slide surface which terminates at a lip wherein liquids issuing through the metering slots form one or more layers flowing down the slide surface which in turn form a free-falling curtain at the lip having transversely spaced edges and edge guides spaced a distance apart for stabilizing each edge of the curtain. The apparatus includes a preparation pan positionable beneath the hopper lip, the preparation pan having a surface for intercepting the free-falling curtain and edge walls extending from the preparation pan, the edge walls spaced apart from said edge guides when the preparation pan is positioned beneath the hopper lip wherein the free-falling curtain is stabilized at each edge so that splattering of the liquids is minimized.

For a better understanding of the present invention together with other objects, advantages and capabilities thereof, reference is made to the following description and appended claims in connection with the above-described drawings.

DETAILED DESCRIPTION OF THE PREFERRED EMBODIMENT

Figure 1:
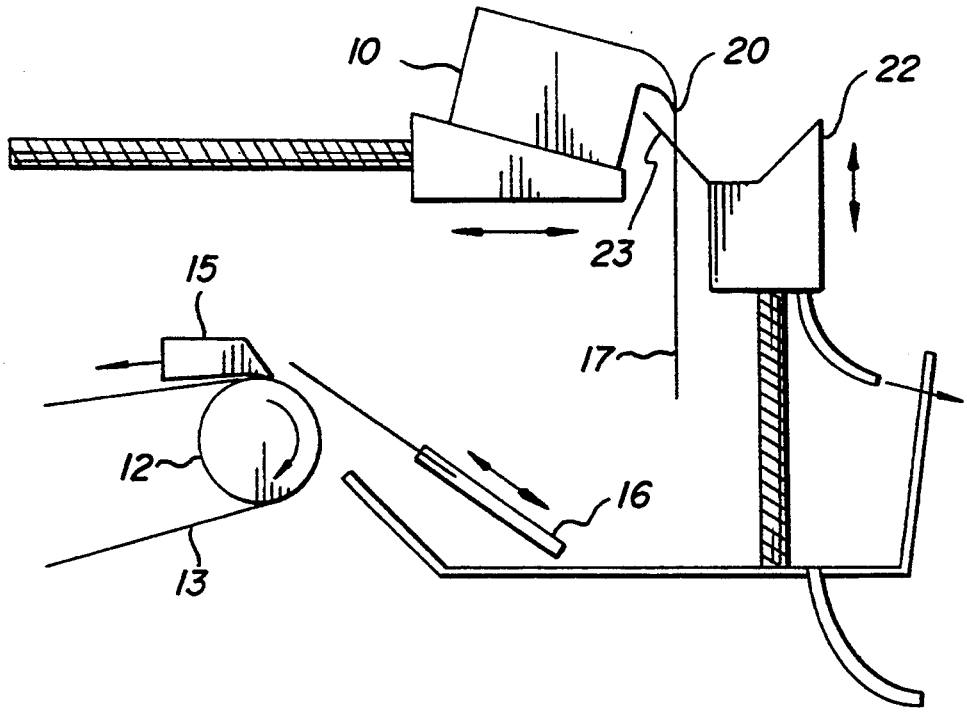
FIG. 1 PRIOR ART
FIG. 1 shows a schematic diagram of a coating hopper including high speed start/finish pan and a preparation pan of the prior art.

Shown in FIG. 1 is a schematic view of a coating station. The coating station includes a coating hopper 10 which can be translated to a position in front of the coating roller 12 in an effort to keep the coating point free of contamination. While in operation, the coating hopper is translated to a position over the coating roller 12 in order to coat the support 13 with a falling curtain of coating composition. The boundary air vacuum baffle 15 removes air moving with the web that would otherwise disturb the free-falling curtain. Attached to the coating hopper 10 are edge guides 17 which stabilize each edge of the free-falling curtain. While the coating hopper is being prepared, it is positioned over a sink leading to the drain in order to catch the free-falling liquids. Once a stable curtain of coating composition has been established, the coating hopper is translated over the coating roll and the coating operation is started by activating the high speed start/finish pan 16. The high speed start/finish pan is described in U.S. Pat. No. 5,105,758.

In order to eliminate the splashing and contamination which can occur when the hopper is in the preparation position, a preparation pan 22 is placed directly below the hopper lip 20. This preparation pan is elevated to just beneath the hopper lip at the inception of the hopper preparation and quickly lowers after hopper preparation to allow the formation of a full free-falling curtain. FIG. 1 shows the preparation pan 22 in relation to other coating equipment.

Figure 2:
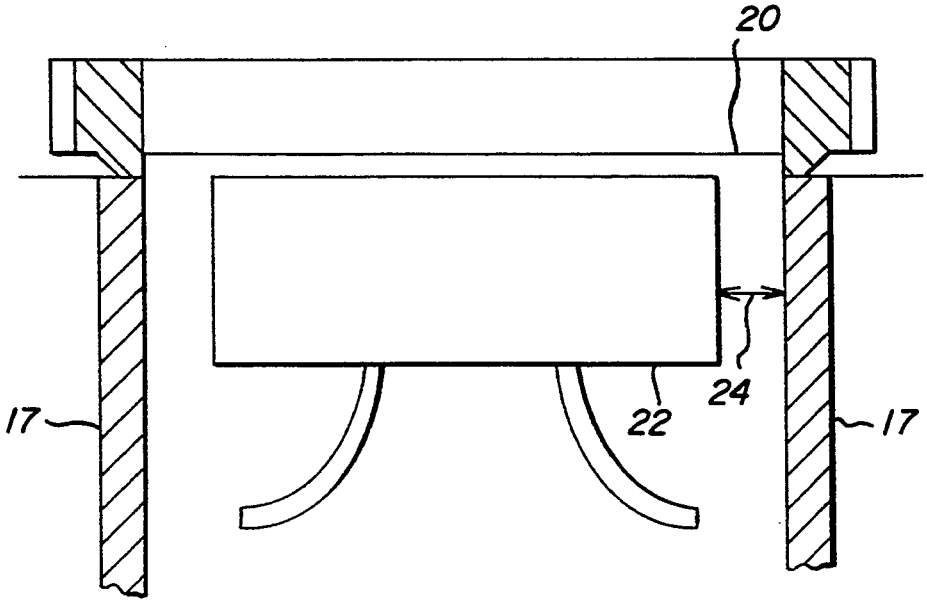
FIG. 2 PRIOR ART
FIG. 2 shows a front view of a hopper using a prior art preparation pan.

FIG. 2 shows a front view of the preparation pan 22 in position beneath the hopper lip 20. The majority of the preparation pan is located in front of the curtain and edge guide 17. There is a pan extension 23 (see FIG. 1) which fits beneath the hopper lip and actually intercepts the curtain. This pan extension 23 acts as a slide for the liquid to flow down and directs the liquid into the preparation pan 22.

Figure 3:
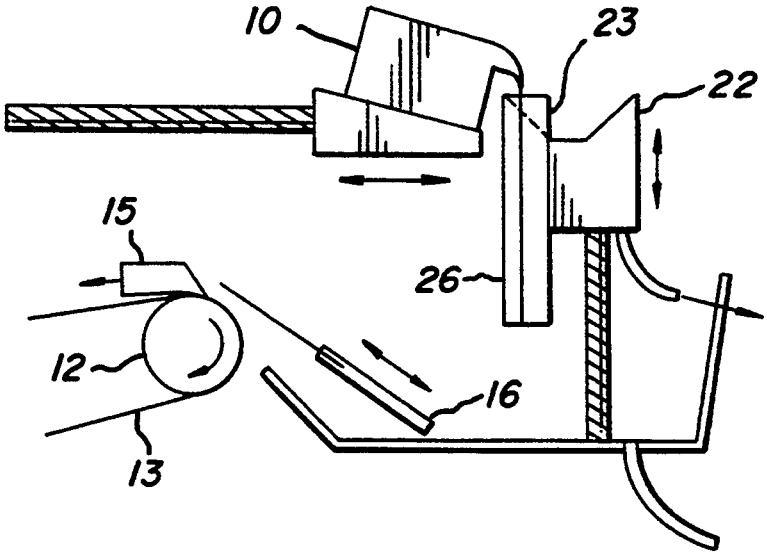
FIG. 3 shows a side view of a hopper including a preparation pan of the present invention.
Figure 4:
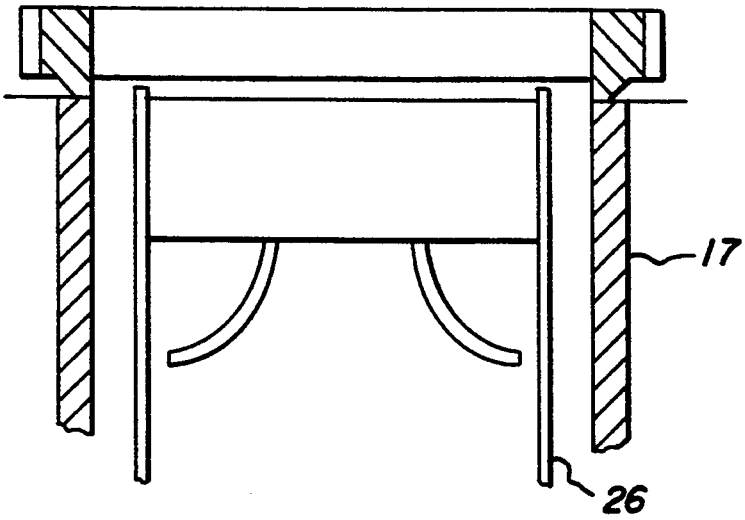
FIG. 4 shows a front view of a hopper including a preparation pan of the present invention.

There is a gap 24 between the edge of the preparation pan 22 and the edge guide 17 which is necessary in order to insure that there is no physical interference between the preparation pan and the edge guides. This edge area is susceptible to contamination due to splattering and pulsatile flow as described in the background of the invention. In order to control the fluid in the edge region, an improved preparation pan has been devised. This preparation pan maintains a curtain in the edge region by introducing an edge wall for the curtain along the side of the preparation pan. FIGS. 3 and 4 show the improved preparation pan with edge walls from front and side views. The improvement of the preparation pan of the present invention is the edge walls 26 positioned on each side of the preparation pan extension 23. The edge walls are spaced about 0.5 to 5.0 cm from the edge guides in order to minimize the amount of solution that does not fall into the preparation pan and, therefore, must be managed in some other manner. These edge walls allow the maintenance of a curtain in the edge regions between the edge walls and the edge guides 17 thereby eliminating splashing that can contaminate the edge guide and the other pieces of coating equipment located nearby.

Figure 5:
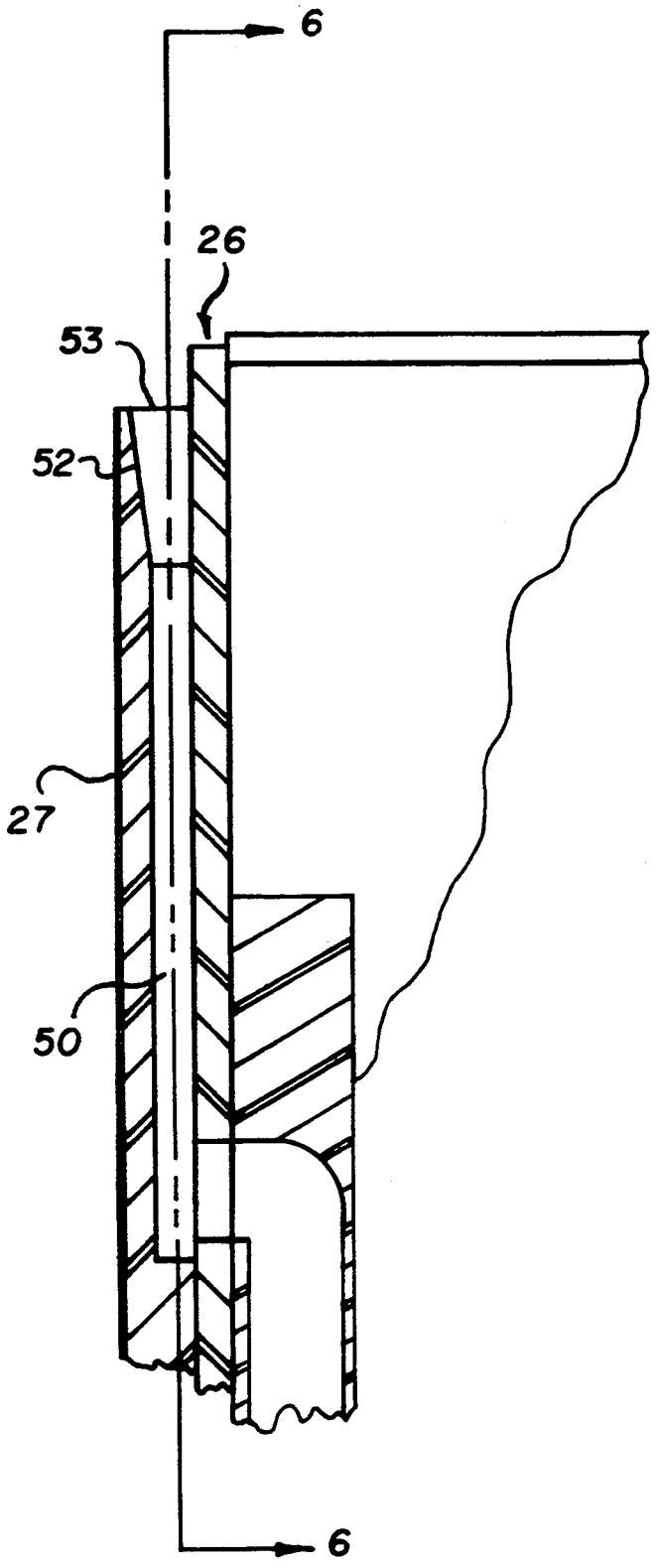
FIG. 5 shows a side sectional view of the edge wall used with the preparation pan of the present invention.
Figure 6:
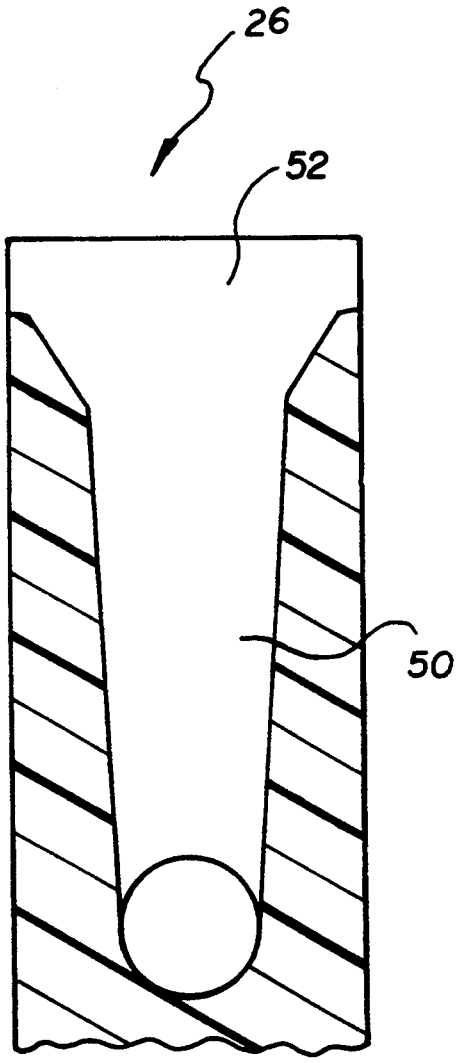
FIG. 6 shows a front sectional view of the edge wall used with the preparation pan of the present invention.

FIGS. 5 and 6 show the preferred embodiment of the edge wall used with the preparation pan of the present invention. Shown in FIG. 5 is a side sectional view of one edge wall 26. The edge wall includes a duct 50 for introducing lubricating fluid, preferably water, through a radially diverging slot 52. The introduction of the lubricating fluid is done to reduce the drag along the textured surface 27 of the edge wall facing the edge guide and allow for curtains of lower flow rates, higher viscosity and greater disturbance. In this preferred embodiment of the invention, the edge wall lubricating fluid outlet 53 is essentially a weir. This promotes wetting of the entire edge wall surface and is not susceptible to becoming plugged with solutions that may solidify or congeal. This outlet has the further advantage of being self-adjusting with respect to the curtain. It has been found that the highest edge wall lubricating fluid flow rate occurs at the horizontal position on the edge wall where the fluid curtain is located. This enables the curtain to be extremely stable along the edge -wall since the locally high lubricating fluid flow rate greatly reduces the drag along the edge wall.

The objective of the edge wall of the preparation pan is to create a film of lubricating liquid on the edge wall. Wettability can be determined by measuring the static contact angle of the lubricating liquid on the edge wall surface. The smaller the angle, the more wettable is the edge wall surface with respect to the lubricating liquid. Surfaces that are not inherently wettable, such as plastics exhibit static contact angles of close to or greater than 90 degrees, and form rivulets of lubricating fluid. However, such surfaces may be made wettable by applying a coating or surface treatment, by introducing surfactant into the lubricating water or by roughening the surface. Roughening of the surface can be accomplished by mechanical or chemical means. The edge wall shown in FIGS. 7A and 7B were toughened by mechanical means.

Figure 7A:
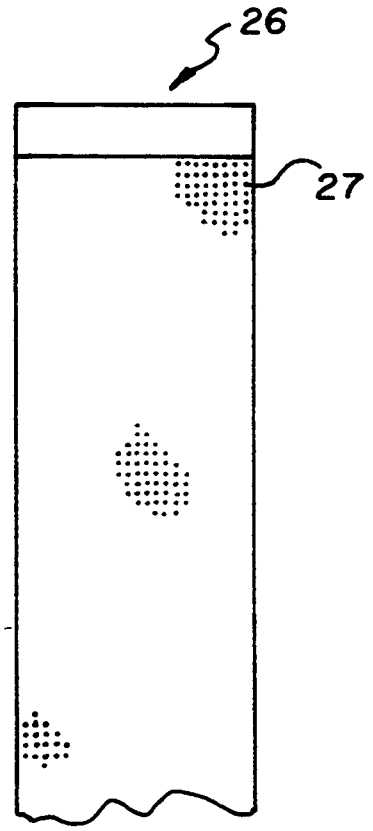
FIG. 7A shows the texture of the wettable plastic edge wall.
Figure 7B:
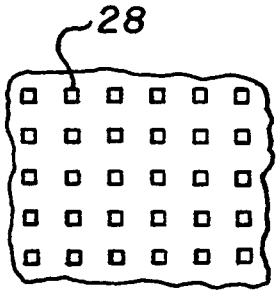
FIG. 7B shows an exploded view of the texturing of the edge wall.

Shown in FIGS. 7A and 7B are front views of the textured surface 27 of the edge wall 26. The textured surface comprises horizontal and vertical grooves which leave raised islands 28 on the surface. This is shown in detail in FIG. 7B which is an enlarged view of the surface 27 in FIG. 7A. For convenience, the texturing of the whole surface is not shown in FIG. 7A.

Plastics are less expensive than metals. Plastics are softer than metals and are, therefore, safer to use around coating hoppers as they are less likely to scratch the hopper surface. However, plastics are generally poorly wettable, a typical contact angle being about 80 degrees. In a preferred embodiment, the spreading of lubricating liquid over a plastic edge wall is promoted by cutting a cross-hatched pattern of shallow, closely spaced channels into the surface of the edge wall as shown in FIGS. 7A and 7B. Such a pattern can ensure the complete spreading of lubricating liquid on edge walls made of metal and other more wettable materials as well.

A preparation pan with edge walls flushed with lubricating fluid having a very wettable surface is the preferred solution to the contamination problem that occurs during hopper preparation. This is illustrated in the following example.

EXAMPLE

A hopper preparation sequence as previously described was carried out using a preparation pan with an edge wall in accordance with the present invention. The edge wall was made of LEXAN® and had a checkerboard pattern inscribed as shown in FIGS. 7A and 7B. The checkerboard pattern was also inscribed on the side of the edge wall that is parallel to the plane of the free-falling curtain. This increased stability of the curtain formed between the edge wall and edge guides as the hopper moved toward the preparation pan to prepare the hopper and when the hopper was moved away from the preparation pan. The checkerboard pattern included grooves that were 0.76 mm wide and 0.25 mm deep. The grooves were spaced at a center-to-center distance of 1.0 mm in both the horizontal and vertical directions. Lubricating water was supplied to the edge wall at a flow rate of 300 $cm^3$/min by means of a diverging slot as shown in FIGS. 5 and 6. The slot width at 53 parallel to the plane of the curtain was 4 mm. The wall length at 53 parallel to the plane of the curtain was 0.9 cm. The edge wall dimension in a horizontal plane was 3.2 cm. Water was initially flushed through a conventional curtain coating hopper and was then replaced by coating solutions. The coating solutions were comprised of three layers each having a viscosity of 40 centipoise. All of the layers contained water, gelatin, and a carbon/gelatin dispersion which was added to facilitate observation. The top and bottom layers contained appropriate surfactants. The coating solutions were flowed at a total rate of 2.0 $cm^3$/cm/s. During the purging of the water by the coating solutions a curtain was maintained between the edge wall and the curtain edge guide 17, which were of the dual-wire type described in U.S. patent application 07/979,504. The flow rate of lubricating water on the wire edge guide was 30 cc/min. The curtain was maintained after all of the water was purged from the hopper and only coating solutions were flowing. The curtain was extremely stable and would spontaneously heal even when the curtain was purposely punctured. The curtain would stay attached to the side of the edge wall as the hopper was moved perpendicular to the plane of the curtain. As a result of the maintenance of the curtain between the edge wall and the edge guide, no detrimental splashing of coating solutions occurred, and there was no contamination of the edge guide or other equipment.

While there has been shown and described what are at present considered to be the preferred embodiments of the invention, it will be obvious to those skilled in the art that various changes and modifications can be made therein without departing from the scope of the invention as defined by the appended claims.

What is claimed:

1. An apparatus for preparing a coating hopper having one or more metering slots between one or more hopper elements, the hopper elements forming a slide surface terminating at a lip wherein coating liquids issuing through the metering slots form one or more layers flowing down the slide surface which form a free-falling curtain at the lip having transversely spaced edges and edge guides spaced a distance apart for stabilizing each edge of the curtain, the apparatus comprising:

a preparation pan positionable beneath the hopper lip said preparation pan having a surface for intercepting the free-falling curtain;

edge walls extending from said preparation pan, said edge walls spaced apart from the edge guides when said preparation pan is positioned beneath the hopper lip, said edge walls having an outer surface facing each edge guide; and flushing means for issuing a lubricating solution along the outer surface of the edge walls wherein the free-falling curtain not intercepted by said preparation pan is stabilized at each edge by said edge walls such that splattering is minimized.

2. The apparatus according to claim 1 wherein the edge walls are spaced apart from the edge guides by approximately 0.5 to 5.0 centimeters.

3. The apparatus according to claim 1 wherein the outer surfaces of each edge wall have a contact angle of 60 degrees or less with the lubricating liquid.

4. The apparatus according to claim 1 wherein the outer surface of each of said edge walls comprises shallow closely spaced grooves.

5. The apparatus according to claim 1 wherein the outer surface of each of said edge walls has been roughened to improve wettability.

6. The apparatus according to claim 1 wherein the outer surface of each of said edge walls has been chemically treated to improve wettability.

7. The apparatus according to claim 1 wherein the edge walls comprise stainless steel.

8. The apparatus according to claim 1 wherein the edge walls comprise titanium.

9. The apparatus according to claim 1 wherein the edge walls comprise plastic.

10. The apparatus according to claim 1 wherein said flushing means comprise a radially diverging slot terminating at a top of each edge wall.

11. The apparatus according to claim 1 wherein said flushing solution is water.

* * * * *